US005749504A

United States Patent [19]

Bieker

[11] Patent Number: 5,749,504

[45] Date of Patent: May 12, 1998

[54] BLOOD COLLECTION TUBE HOLDER

[76] Inventor: Michael C. Bieker, 6358 Los Altos Dr., Rockford, Mich. 49341

[21] Appl. No.: 257,685

[22] Filed: Jun. 9, 1994

[51] Int. Cl.[6] ..... A45F 3/14

[52] U.S. Cl. ..... 224/221; 224/267; 224/251; 224/901.8; 24/3 R

[58] Field of Search ..... 224/901, 904, 224/165, 195, 219, 222, 247, 251, 267, 220, 221, 901.8; 24/3 A, 3 B, 3 F, 11 CT, 3 R, 3 J, 10 R, 11 F, 545, 547, 563, 306; 248/316.7

[56] References Cited

U.S. PATENT DOCUMENTS

| | | | |
|---|---|---|---|
| 1,081,261 | 12/1913 | Barrett | 224/247 |
| 1,701,057 | 2/1929 | Thatcher | 24/3 A |
| 2,456,445 | 12/1948 | Rees et al. | 224/247 |
| 3,273,766 | 9/1966 | Cosentino | 224/247 |
| 4,063,647 | 12/1977 | Blackmore | 248/316.7 |
| 4,606,484 | 8/1986 | Winter et al. | 224/222 |
| 4,733,808 | 3/1988 | Turner, Jr. et al. | 224/267 |
| 5,140,723 | 8/1992 | Genzel | 24/3 A |
| 5,232,136 | 8/1993 | Unger | 224/247 |
| 5,263,618 | 11/1993 | Bieker | 224/901 |
| 5,289,961 | 3/1994 | Levitt et al. | 224/219 |
| 5,351,866 | 10/1994 | Foss | 224/247 |

*Primary Examiner*—Henry J. Recla
*Assistant Examiner*—Gregory M. Vidovich
*Attorney, Agent, or Firm*—Waters & Morse P.C.

[57] ABSTRACT

A method and device for handling blood sample tubes provides a group of interconnected tube receptacles releasably secured to the wrist of an operator. The receptacles are preferably arranged transversely to the wrist in parallel relationship. They are C-shaped in cross-section, and capable of peripheral resilient deformation to provide a gentle clamping action on the tubes.

10 Claims, 2 Drawing Sheets

BLOOD COLLECTION TUBE HOLDER

FIELD OF THE INVENTION

This invention provides a method and a device related to the handling of blood sample containers.

BACKGROUND OF THE INVENTION

Clinical procedures often require the taking of a plurality of blood samples from the same patient. Maintaining the placement of the needle inserted in the patient while completing and disconnecting the conduits leading to the tubular containers easily becomes a "three-handed" operation requiring a high degree of skill, experience, and patience on the part of the operator. Once the samples are taken, it becomes vital to keep the samples from each patient grouped together for further processing. Various techniques have been worked out to accomplish this, but improvement is needed to reduce the level of skill involved and make it easier to isolate the samples from each patient.

SUMMARY OF THE INVENTION

This invention provides a method and a device for handling the standard tubular containers for blood samples. The tubes are releasably secured to the wrist of an operator, and in a position preferably parallel to each other and transverse to the wrist of the operator. After filling each tube and inserting the tube into (or back into) the receptacles, the group of interconnected receptacles, together with the tubes, is handled as a unit for further processing.

The device includes a plurality of interconnected receptacles which are preferably attached to a backing plate, with each of the receptacles adapted to receive one of the tubular containers. A disengageable strap secures the group on the backing plate to the wrist of the operator preferably in a position transverse to the wrist. These receptacles are C-shaped in cross section, with a tapered slot along the side forming this configuration. The containers are of a material with a sufficient resilience to permit the receptacles to be received with a gentle clamping action.

DESCRIPTION OF THE PREFERRED EMBODIMENT

Figure 1:
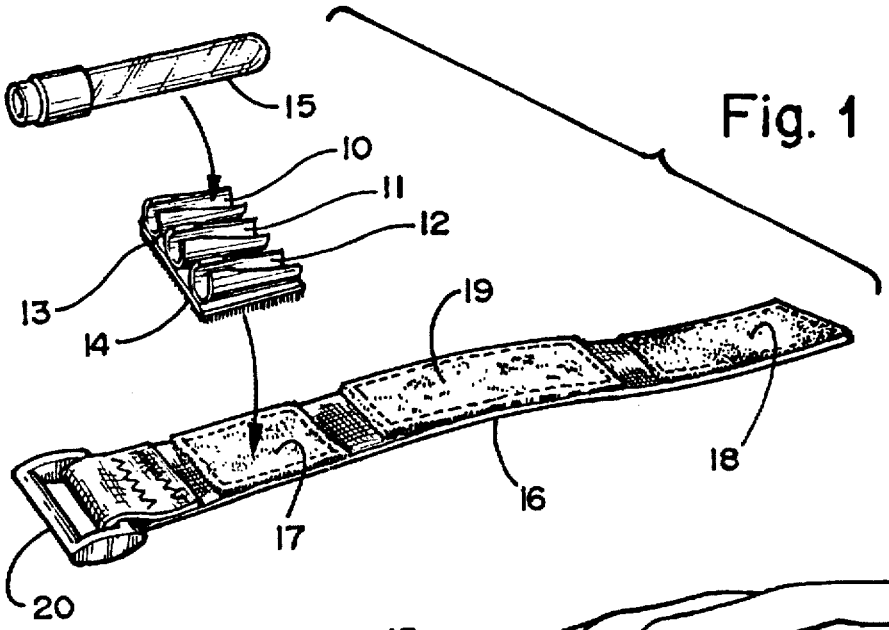
FIG. 1 is an exploded perspective view of the components of the device.

Referring to FIG. 1 of the drawings, a group of receptacles 10, 11, and 12 are shown bonded to a backing plate 13 provided with a hook and loop fastener (e.g., Velcro) patch 14 bonded to the underside of the backing plate. The receptacles are essentially peripherally interrupted tubes producing a C-shaped cross-section, and providing a tapered slot (in the direction of the axes of the receptacles). The widest part of the slots should be about a quarter of the cylindrical circumference. These receptacles are bonded to the backing plate by an adhesive. The cross-section of the receptacles produces a peripheral resilience such that the standard tubular containers 15 are receivable with a slight resilient clamping action. The taper of the slots facilitates the insertion of the containers 15, preferably from the end of the receptacles where the slot is widest.

Figure 2:
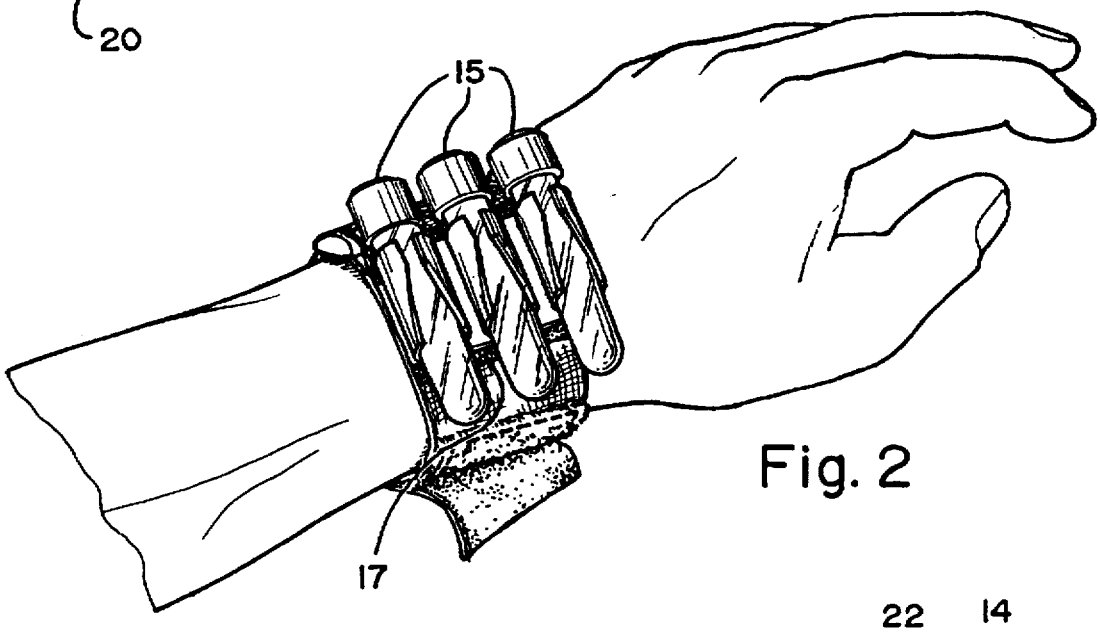
FIG. 2 is a perspective view showing the loaded device attached to the wrist of an operator.
Figure 3:
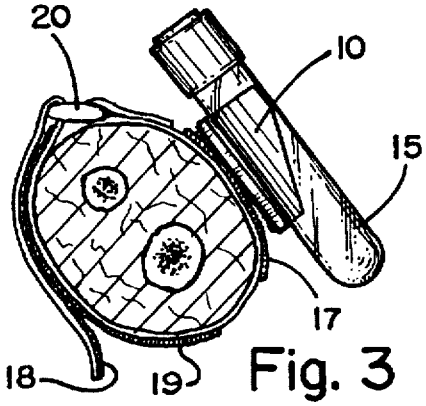
FIG. 3 is a transverse section through the installed device.
Figure 4:
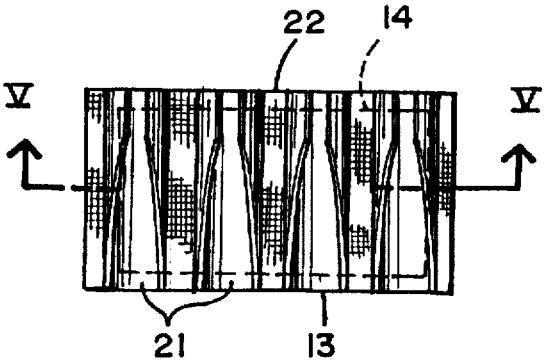
FIG. 4 is a plan view of a group of receptacles attached to a backing plate for the handling of the contained items as a unit.
Figure 5:
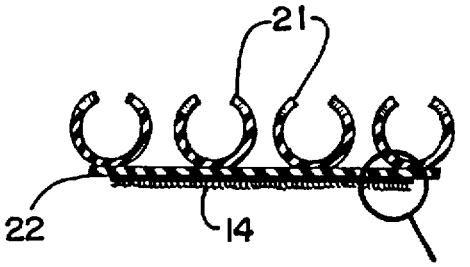
FIG. 5 is a section through the sub-assembly of the receptacles and the backing plate, on the plane V—V of FIG. 4.
Figure 6:
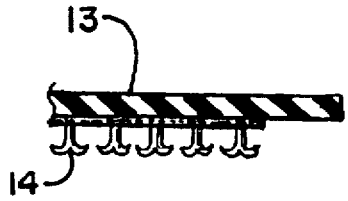
FIG. 6 is an enlarged end view of the details of the Velcro patch mounted on the backing plate.
Figure 7:
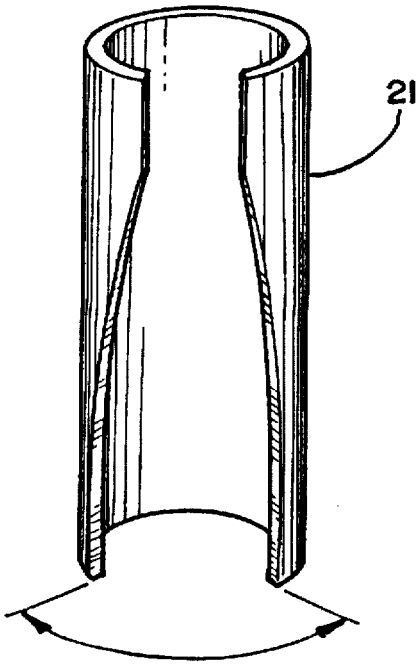
FIG. 7 is an enlarged perspective view showing one of the receptacles.
Figure 8:
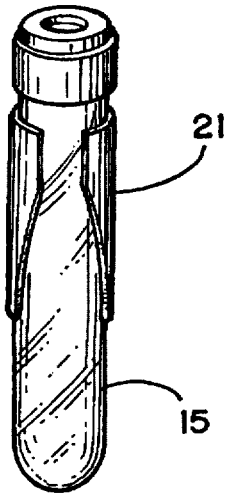
FIG. 8 is a perspective view showing a tubular container installed in one of the receptacles.
Figure 9:
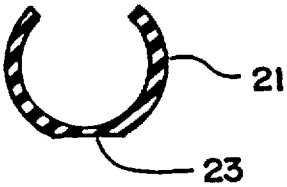
FIG. 9 is a cross-section showing the configuration of a receptacle.

The group of receptacles, together with a backing plate, is releasably mounted on the wrist strap 16 through a Velco type patch 17 on the strap which mates with the Velcro type patch 14 on the backing plate. The strap itself is preferably releasably secured to the wrist of the operator as shown in FIG. 2 through the interengagement of the patch 18 with another patch on the strap indicated at 19, possibly with the assistance of the buckle 20. The hook unit 14, together with the mating loop patch 17 on the strap, should have a strong interengagement. A Velcro brand hook unit HTH-23, No. 751 which has a T-shaped or double hook (as shown in FIG. 6) has been found effective for the securing of the backing plate. The insertion of the containers into the receptacles should not result in the disengagement of the backing plate from the strap. It is also preferable that the patch 14 terminate around its margins somewhat inward from the margins of the backing plate, to avoid inadvertent snagging of the Velcro patches. This is illustrated in FIG. 4, with the periphery of the backing plate being indicated in dotted lines. After the sample containers have been filled, FIG. 4 illustrates how the resulting group of receptacles 21 mounted on a backing plate 22 can be handled as a unit when separated from the wrist strap so that the contained tubes can be kept together.

The present invention contemplates the use of receptacle groups having different numbers receptacles. FIG. 2 shows a group having three receptacles, while FIG. 4 shows a group having four receptacles. The groups also can have two or five receptacles or any number practically desired. Backing plate size is varied to accommodate different numbers of receptacles. The unexpanded receptacles should have a slot width at the narrow end of at least about ⅛ of an inch. The receptacles are best made of a tubing formed of plastic such as polyurethane, of about 1/16 inches wall thickness, with a flat spot 23 to facilitate bonding. The size of the receptacle tubing is selected so that the inside diameter of the tubing is at least slightly smaller than the tube being stored therein. For the most common types of tubes, which are called 16 and 13 millimeter tubes but have respective outer diameters of 15.5 and 12.5 millimeters, tubing having a 7/16 inches (11.1 millimeters) inside diameter is preferred. The tubing has to stretch open somewhat to accept either size tube and resiliently grips the tube to hold it in place.

The procedure in the use of the method and the device is preferably as follows:

1. Tighten the wrist band firmly around the wrist of the hand that is holding the needle equipment. The wrist band must be tight for the system to perform properly. It should be positioned as shown in the drawing, with the loop portion of the Velcro exposed on the underside of the wrist to provide the best position of the device. The wrist band can be placed over a lab coat, or directly on the wrist, whichever is more convenient.

2. Attach the sub-assembly of the backing plate and the receptacles to the installed strap through the interengagement of the appropriate Velcro patches. The position of this sub-assembly can be varied to suit the particular technique used by the operator during the drawing process. The predetermined sequence of the tubes should be preserved in their insertion into the receptacles.

3. Proceed with drawing of the samples from the patient. As each collection tube is filled and removed from the needle, it should be returned to its appropriate receptacle, and carefully snapped into position.

4. The spacing of the receptacles apart from each other also is important. When the preferred receptacle tubing size is used for 16 mm and 13 mm blood collection tubes, there should be at least a ⅛ inch spacing between the receptacles so as to give the receptacle tubing from to flex open to receive the blood collection tubes.

5. When the drawing process has been completed, the group of receptacles (including the filled tubes) should be promptly removed by detaching the backing plate so that the sequence of tubes is preserved for further processing.

I claim:

1. In combination, a blood collection tube holder and a plurality of blood collection tubes removably mounted therein, the blood collection tube holder comprising a wrist band adapted to be fastened around a user's wrist and a plurality of blood collection tube holders mounted side by side on an exterior surface of the wrist band, each of the tube holders comprising a resilient clip member having an opening in a side facing away from the wrist band that receives one of said plurality of blood collection tubes laterally therethrough, each of the clip members having an inside size at least slightly smaller than the outside diameter of the blood collection tube mounted therein, such that the tube is resiliently gripped and held by the clip member.

2. The combination of claim 1 wherein at least one blood collection tube having an outside diameter of about 12.5 millimeters and at least one blood collection tube having an outside diameter of about 15.5 millimeters, the clip members comprising tubular members that have an inside diameter slightly smaller than the at least one blood tube having an outside diameter of about 12.5 millimeters but are sufficiently resilient and spaced sufficiently far apart such that they will open sufficiently to receive and hold the at least one blood collection tube having an outside diameter of about 15.5 millimeters as well as the at least one blood collection tube having an outside diameter of about 12.5 millimeters.

3. The combination as in claim 1 and further comprising:

a mounting plate having inner and outer surfaces;

means for releasably mounting the mounting plate on the exterior surface of the wrist band so as to permit removal of the mounting plate from the wrist band without releasing the wrist band from the user's wrist;

the tube holders being mounted side by side on the outer surface of the mounting plate, such that the mounting plate and tube holders can be removed as a unit from the wrist band.

4. The combination as in claim 3 wherein the means for releasably mounting the mounting plate on the wrist band comprises hook and loop fasteners.

5. The combination as in claim 3 wherein the means for mounting the mounting plate on the wrist band is adapted to support the mounting plate in a position such that the mounting plate faces the user when the user's wrist is in front of the user's face, with the tube holders being oriented so as to support blood collection tubes in a position transverse to the longitudinal direction of the user's arm.

6. The combination of claim 3 wherein:

the tube holders comprise elongated, resilient, tubular members, each tubular member having a back side affixed to the mounting plate and having a longitudinal slot formed in a front side facing away from the mounting plate, the interior dimensions of the tubular member and the width of the slot being such that one of the blood collection tubes can be pressed into and removed from the tubular member in a lateral direction through the slot in the front side of the tubular member, with the one tube being resiliently held in the interior of the tubular member by engagement with the interior portion of the tubular member.

7. The combination as in claim 6 wherein the blood collection tubes comprise at least one blood collection tube having an outside diameter of about 12.5 millimeters.

8. The combination as in claim 7 wherein the tubular members comprise polyurethane tubing having an inside diameter of about seven-sixteenth inches (11.1 millimeters).

9. The combination as in claim 6 wherein the slots in the tube holders are tapered and are at least about one-eighth inch (3.17 millimeters) at a narrowest end of the slot.

10. The combination as in claim 6 wherein the blood collection tubes comprise at least one blood collection tube having an outside diameter of 12.5 millimeters and the tubular members are spaced laterally apart by at least one-eighth inch (3.17 millimeters).

* * * * *